US007109820B1

(12) United States Patent
Lucas et al.

(10) Patent No.: US 7,109,820 B1
(45) Date of Patent: Sep. 19, 2006

(54) CIRCUIT DEVICE WITH A CONTACT ELEMENT FOR ELECTRICALLY CONNECTING A WAVE GUIDE AND A CONDUCTOR STRIP IN A NEARLY STRESS-FREE MANNER

(75) Inventors: Bernhard Lucas, Besigheim (DE); Frank Schatz, Kornwestheim (DE); Juergen Seiz, Welzheim (DE); Heinz Eisenschmid, Stuttgart (DE); Achim Dieterich, Murrhardt (DE); Andreas Kugler, Alfdorf (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/488,398

(22) Filed: Jan. 20, 2000

(30) Foreign Application Priority Data

Jan. 21, 1999 (DE) ..... 199 02 240

(51) Int. Cl.
*H01P 5/107* (2006.01)

(52) U.S. Cl. ..... 333/26; 333/34

(58) Field of Classification Search ..... 333/26, 333/21 R, 34
See application file for complete search history.

(56) References Cited

U.S. PATENT DOCUMENTS 5,969,580 A * 10/1999 Maillet et al. ..... 333/26

FOREIGN PATENT DOCUMENTS

| | | |
|---|---|---|
| JP | 59-212002 | 11/1984 |
| JP | 1-132203 | 5/1989 |

* cited by examiner

*Primary Examiner*—Benny Lee
(74) *Attorney, Agent, or Firm*—Michael J. Striker

(57) ABSTRACT

The circuit device has a contact element, which electrically connects a wave guide (1) with a conductor strip (2). To avoid mechanical stresses due to thermal expansion the contact element is a pre-stressed prefabricated leaf spring having reproducible properties, which is bonded at one contacting area to the wave guide (1) or the conductor strip (2) by electrically conducting adhesive or glue, while a sliding contact is provided on the conductor strip (2) or the wave guide (1) at the other contacting area. The prefabricated leaf spring is preferably a MIGA leaf spring precisely made by UV depth lithography and multiplayer galvanic methods in a batch production process.

14 Claims, 2 Drawing Sheets

CIRCUIT DEVICE WITH A CONTACT ELEMENT FOR ELECTRICALLY CONNECTING A WAVE GUIDE AND A CONDUCTOR STRIP IN A NEARLY STRESS-FREE MANNER

BACKGROUND OF THE INVENTION

1. Field of the Invention

The present invention relates to a circuit device with a contact element for electrically connecting a wave guide to a conductor strip.

2. Prior Art

A so-called stepping transformer, whose geometry is substantially determined by the wavelength of the frequencies used, is employed in high frequency circuitry in a frequency range over 50 GHz at the junction between a wave guide and conductor strip circuit elements.

Usually an electrical connection of the final stage of the stepping transformer to the conductor strip circuit device is required. This electrical connection is, for example, accomplished by glued conducting small gold bands. These small gold bands are either mounted over a corner or on the bottom side of the final stage. This fabrication method is very expensive. Furthermore the electrical connection is put under great mechanical stress by possible relative motion due to differing thermal expansion of the metallic wave guide and the dielectric conductor strip substrates.

SUMMARY OF THE INVENTION

It is an object of the present invention to provide a circuit device with a contact element for electrically connecting the wave guide to a conductor strip, which does not have the above-mentioned disadvantage.

According to the invention the contact element electrically connects the wave guide with the conductor strip by means of two contacting areas of the contact element and is made from an accurately prefabricated leaf spring having predetermined reproducible properties. This leaf spring is connected at one of the contacting areas to the conductor strip or to the wave guide by means of an electrically conductive glue and a sliding contact is provided at the other contacting area and the spring or the leaf spring is connected at the other contacting area by an electrically conductive glue or adhesive portion and the leaf spring is bent into a U-shape, or the leaf spring is connected at the other contacting area by a highly flexible electrically conductive adhesive section.

This type of electrical connection is easy to make. Different thermal expansion properties of the different materials are easily and satisfactorily compensated.

Advantageous additional embodiments are set forth in the dependent claims. Their features, in so far as it is appropriate and significant, may of course be combined with each other.

The sliding contact can move with the participating structural elements without experiencing significant mechanical stresses due to relative motions (originating, for example, from differing thermal expansion properties). Without the device according to the invention the contacting areas would be subjected to impressibly large mechanical stresses. The motion is compensated by the coil spring itself and/or by the pre-tensioned sliding contact in a nearly stress-free manner.

Relative motion of the parts occurs without tearing off the contact element. The contact junction is reproducible and not dependent on the bond forming and processing. Thus the electrical tuning between the wave guide and the conductor strip is reproducible.

The leaf spring for application in high-frequency engineering is especially small (length, about 100 to 200 μm, thickness about 50 μm). The leaf spring is formed with very great accuracy, particularly as a so-called MIGA leaf spring (MIGA means microgalvanic). UV depth lithography or comparable methods of structuring polymers in combination with mutlilayer microgalvanic methods are suitable for making the leaf spring. Laser processing or high precision punching or stamping can be suitable for making the leaf spring.

Thus simple but precise or exact fabrication methods are possible for the leaf spring. Tolerances of <±10 μm may be obtained for the above-described contact element with UV depth lithography. A wide range of materials can be selected so that special spring properties can be obtained. An automatic mounting of the leaf spring and easy manufacture of the electrical connection are possible. Several leaf springs can be economically made at the same time in a batch process (which means for many applications).

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
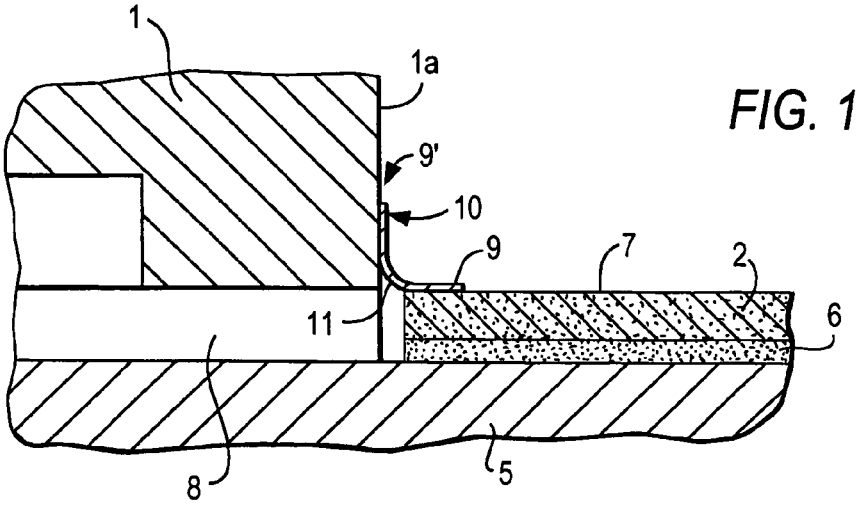
FIG. 1 is a schematic cutaway cross-sectional view through a first embodiment of a circuit device with a contact element for connecting a wave guide to a conductor strip.

According to FIGS. 1 to 5, a wave guide 1, which is in the form of a stepping transformer, and a conductor strip substrate 2 rest on a metal plate 5. The wave guide is screwed on the metal plate 5. The form of the stepping transformer is not described here in detail. The conductor strip substrate 2 is glued on the metal plate 5, with the help of an electrically conductive adhesive material or glue 6. A conductor strip 7 is provided on the upper side of the conductor strip substrate 2. This conductor strip is a component of a microwave IC (MIC). The wave guide 1 has a coupling opening 8 (see FIG. 1) in the vicinity of the conductor strip. However the conductor strip 7 and conductor strip substrate 2 are located outside of the wave guide 1 as shown in FIGS. 1 to 5.

According to FIG. 1, a leaf spring 11 operating as an electrically conductive contact element is bonded to the conductor strip 7 at a first contacting area 9 with an electrically conducting glue or adhesive. Silver-filled epoxy resin glue is suitable as the adhesive material. The wave guide 1 is assembled after the leaf spring 11 has been bonded with the adhesive, so that the mechanically pre-tensioned leaf spring 11, which forms a sliding contact 10 at a second contacting area 9', presses resiliently against an exterior surface 1*a* of the wave guide 1, which extends substantially perpendicularly to the plane of the conductor strip 7. The contact element forms a low impedance contact between the wave guide 1 and the conductor strip 7. The low impedance connection is required in order to permit an optimum tuning of the coupling of the electromagnetic waves from the wave guide 1 into the conductor strip 7. Besides the geometry of the junction plays an important role.

Relative motions, especially thermally dependent relative motions, between the wave guide 1 and the conductor strip 7 are compensated with the help of the sliding contact 10 and the spring force of the leaf spring 11. Without this device, the contacting areas would be subjected to impressibly large mechanical stresses.

Figure 2:
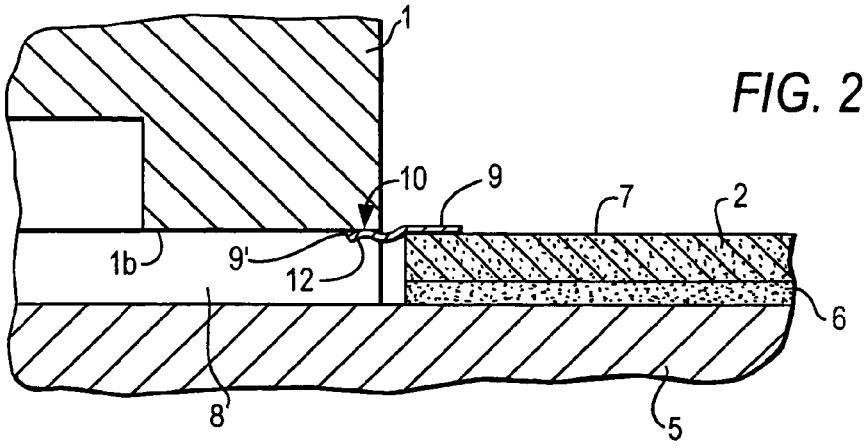
FIG. 2 is a schematic cutaway cross-sectional view through a second embodiment of a circuit device with a contact element for connecting a wave guide to a conductor strip.

FIG. 2 illustrates another embodiment for the leaf spring 12. This embodiment is similar to the embodiment shown in FIG. 1, but differs from it because the surface 1*b* of the wave guide 1 on which the leaf spring 12 bears is substantially parallel to the conductor strip 7 and inside the coupling opening 8 of the wave guide. In this embodiment also the leaf spring 12 acting as contact element is fixed to the conductor strip 7 at a first contacting area 9 by an electrically conductive adhesive. Similarity the leaf spring 12 bearing on the surface 1*b* of the wave guide 1 at the other contacting area 9' forms a sliding contact 10 in electrical contact with the wave guide 1.

Figure 3:
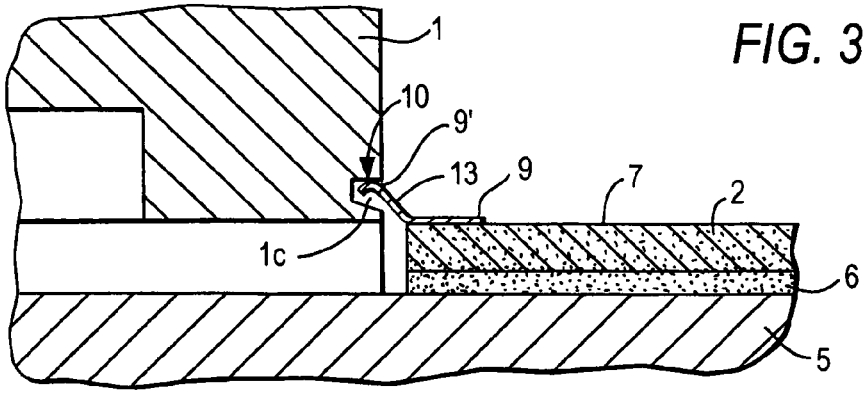
FIG. 3 is a schematic cutaway cross-sectional view through a third embodiment of a circuit device with a contact element for connecting a wave guide to a conductor strip.

This latter situation in regard to FIG. 2 is also true of the third embodiment shown in FIG. 3. In the embodiment shown in FIG. 3, the leaf spring 13 is bonded to the conductor strip 7 at a first contacting area 9 with an electrically conductive glue or adhesive. The sliding contact 10 of the leaf spring 13 with the wave guide 1 is located at another contacting area 9' in a cavity 1*c* of the wave guide 1. It is also possible to additionally secure the spring contact in the cavity with a highly flexible electrically conductive glue or adhesive material.

Figure 4:
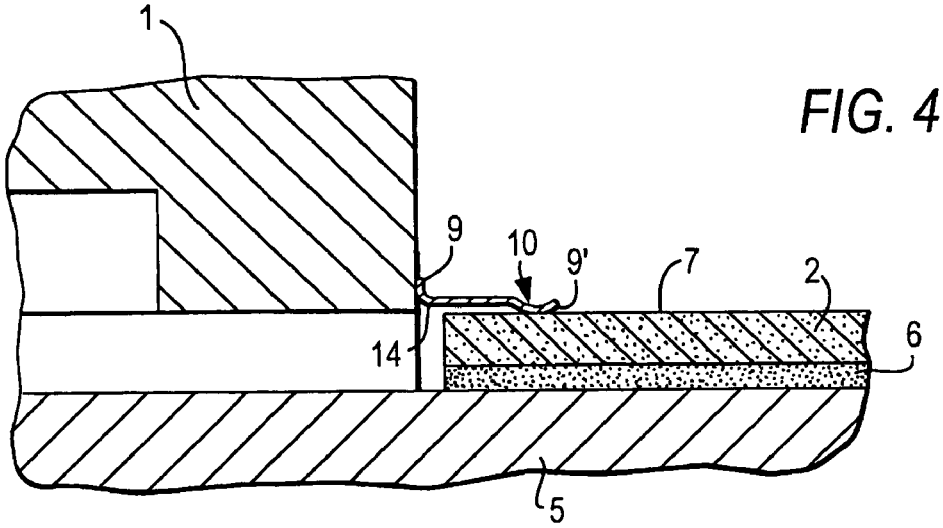
FIG. 4 is a schematic cutaway cross-sectional view through a fourth embodiment of a circuit device with a contact element for connecting a wave guide to a conductor strip.

In the embodiment shown in FIG. 4, a leaf spring 14 is electrically conductively glued to the wave guide 1 at one contacting area 9, while the sliding contact 10 makes electrical contact on the conductor strip 7 on the other conducting area 9'.

Figure 5:
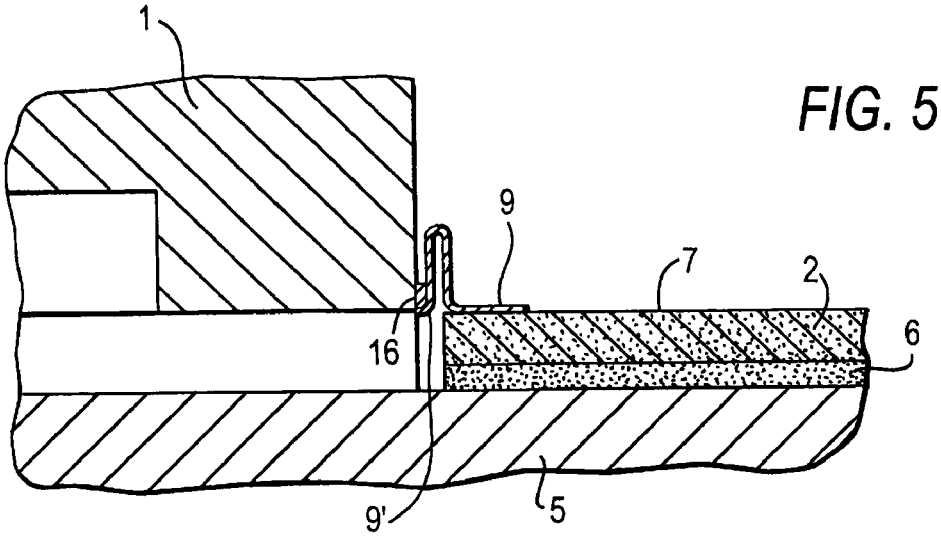
FIG. 5 is a schematic cutaway cross-sectional view through a fifth embodiment of a circuit device with a contact element for connecting a wave guide to a conductor strip.

In FIG. 5, in a fifth embodiment, the leaf spring 15 has a curved U-shape. A first contacting area 9 of the leaf coil spring 15 is glued in an electrically conductive manner to the conductor strip 7. The other contacting area 9' of the leaf spring 15 is formed as an electrically conducting adhesive area 16. This adhesive area 16 can however be highly flexible. The leaf spring 15 need not then be formed so that it is U-shaped.

The disclosure in German Patent Application 199 02 240.2 of Jan. 21, 1999 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a circuit device with a contact element for electrically connecting a wave guide and a conductor strip in a nearly stress-free manner, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. A circuit device for electrically connecting a wave guide (1) with a conductor strip (7), said conductor strip (7) being arranged outside of the wave guide (1), wherein said circuit device comprises a contact element and said contact element consists of a prefabricated U-shaped spring (15) having a first contacting area (9) and a second contacting area (9');

wherein said first contacting area (9) of said contact element is fixed to the conductor strip (7) with an electrically conductive adhesive and said second contact area (9') of said contact element comprises an electrically conductive adhesive area (16) connected with an exterior surface of the wave guide (1).

2. The circuit device as defined in claim 1, wherein said wave guide includes a stepping transformer and said exterior surface of the wave guide is on the stepping transformer.

3. The circuit device as defined in claim 1, further comprising a conductor strip substrate (2) and said conductor strip (7) is mounted on said conductor strip substrate.

4. The circuit device as defined in claim 1, wherein said U-shaped spring is made by laser processing, high precision stamping or high precision punching.

5. The circuit device as defined in claim 1, wherein said U-shaped spring (15) is made by bending a microgalvanic (MIGA) leaf spring with a thickness of about 50 μm and a length of from 100 to 200 μm into a U-shape.

6. The circuit device as defined in claim 5, wherein said leaf spring is made with tolerances of ±10 μm by UV depth lithography and multilayer galvanic methods in a batch production process.

7. A circuit device for electrically connecting a wave guide (1) with a conductor strip (7), said conductor strip being arranged outside of the wave guide (1), wherein said circuit device comprises a contact element and said contact element consists of a prefabricated leaf spring (11 to 14) having a first contacting area (9) and a second contacting area (9');

wherein said first contacting area (9) of said contact element is fixed to a surface of the wave guide (1) with an electrically conductive adhesive and said spring is pre-tensioned so that said second contacting area (9') of said contact element forms a sliding contact (10) in electrical contact with the conductor strip (7), but is slidable on the conductor strip (7); or wherein said first contacting area (9) of said contact element is fixed to the conductor strip (7) with said electrically conductive adhesive and said spring is pre-tensioned so that the second contacting area (9') of said contact element forms a sliding contact (10) in electrical contact with the surface of the wave guide (1), but is slidable on the surface of the wave guide (1).

8. The circuit device as defined in claim 7, further comprising a conductor strip substrate (2) and said conductor strip (7) is mounted on said conductor strip substrate (2).

9. The circuit device as defined in claim 7, wherein said surface (1*a*) is on an exterior of the wave guide (1) and said surface (1*a*) is perpendicular to the conductor strip (7).

10. The circuit device as defined in claim 7, wherein said surface (1*b*) is inside a coupling opening (8) provided in the wave guide and said surface (1*b*) is parallel to the conductor strip (7).

11. The circuit device as defined in claim 7, wherein said leaf spring is a microgalvanic (MIGA) leaf spring that is made by UV depth lithography and multilayer galvanic methods in a batch production process.

12. The circuit device as defined in claim 11, wherein said leaf spring is made with tolerances of ±10 μm and said leaf spring has a thickness of about 50 μm and a length of from 100 to 200 μm.

13. The circuit device as defined in claim 7, wherein said leaf spring is made by laser processing, high precision stamping or high precision punching.

14. The circuit device as defined in claim 7, wherein said wave guide includes a stepping transformer and said surface of the wave guide is on the stepping transformer.

* * * * *